US009352244B2

(12) United States Patent
Aguila

(10) Patent No.: US 9,352,244 B2
(45) Date of Patent: May 31, 2016

(54) PARTY CANNON

(71) Applicant: Rick Aguila, Miami Springs, FL (US)

(72) Inventor: Rick Aguila, Miami Springs, FL (US)

( * ) Notice: Subject to any disclaimer, the term of this patent is extended or adjusted under 35 U.S.C. 154(b) by 0 days.

(21) Appl. No.: 14/725,863

(22) Filed: May 29, 2015

(65) Prior Publication Data

US 2016/0016095 A1 Jan. 21, 2016

Related U.S. Application Data

(63) Continuation-in-part of application No. 13/654,067, filed on Oct. 17, 2012, now Pat. No. 9,044,686.

(60) Provisional application No. 61/548,017, filed on Oct. 17, 2011.

(51) Int. Cl.
*A63H 37/00* (2006.01)
*F41B 7/08* (2006.01)

(52) U.S. Cl.
CPC . *A63H 37/00* (2013.01); *F41B 7/08* (2013.01)

(58) Field of Classification Search
CPC ..... A63H 37/00; F41B 7/08; F41B 7/00
USPC ..... 124/1, 16, 37; 446/4, 5, 310, 473, 475, 446/486
See application file for complete search history.

(56) References Cited

U.S. PATENT DOCUMENTS 706,399 A * 8/1902 Fifer ..... F41B 7/006 124/29
1,560,326 A * 11/1925 Rutherford ..... A63H 37/00 124/62
2,523,805 A * 9/1950 Anthony ..... A63B 69/407 124/16
3,191,342 A * 6/1965 Chalmers ..... A63H 27/14 124/16
3,455,287 A * 7/1969 Oddo ..... A63H 37/00 124/16
4,036,203 A * 7/1977 Chapman ..... F41B 7/08 124/21
4,832,337 A * 5/1989 Estrada ..... A63F 9/0247 273/440
5,015,211 A * 5/1991 Reveen ..... A63H 37/00 124/74
5,087,054 A * 2/1992 O'Neil ..... A63G 31/08 273/384

(Continued)

*Primary Examiner* — Alexander Niconovich
(74) *Attorney, Agent, or Firm* — Robert M. Downey, P.A.

(57) ABSTRACT

A party cannon includes a cannon body and an open-top container movably retained within the cannon body by interconnecting biasing elements. The open-top container is structured and disposed for holding candy, toys, or other items that are loosely filled therein and is held in a loaded position against the force of the one or more biasing elements. Operation of a trigger and locking mechanism releases the open-top container in a rapid forward movement towards an open muzzle end of the cannon body causing the items within the container to be launched outwards from the open muzzle end of the cannon body and through the air so that the items land scattered throughout an area of a room or outdoor ground surface. The container can be re-filled for another launch, thereby allowing for ongoing reuse of the party cannon at the same party and at future events.

6 Claims, 9 Drawing Sheets

(56) References Cited

U.S. PATENT DOCUMENTS 5,149,290 A * 9/1992 Reveen ..... A63H 37/00 124/74
5,304,096 A * 4/1994 Wilk ..... A63H 37/00 40/427
5,597,160 A * 1/1997 Mims ..... A63B 69/407 124/16
5,954,563 A * 9/1999 Spriggs ..... A63H 37/00 102/357
6,364,737 B1 * 4/2002 Sterr ..... A63H 37/00 124/74
6,450,160 B1 * 9/2002 Fu ..... F41B 11/00 124/57
6,572,435 B1 * 6/2003 Wong ..... A63H 37/00 124/16
6,641,458 B1 * 11/2003 Nofsinger ..... A63H 37/00 124/74
6,669,530 B2 * 12/2003 Du ..... A63H 37/00 124/16
6,749,481 B1 * 6/2004 Yap ..... A63H 5/04 124/74
7,350,477 B1 * 4/2008 Tilford ..... A21C 15/002 118/13
7,464,701 B1 * 12/2008 Mendoza ..... F41B 7/08 124/20.1
7,703,447 B2 * 4/2010 Caveza ..... A01K 15/026 119/51.01
7,905,222 B1 * 3/2011 Fenley ..... A63B 69/407 124/16
8,469,011 B2 * 6/2013 Mroczka ..... F41B 7/00 124/16
8,469,768 B1 * 6/2013 Smith ..... A63H 37/00 446/209
8,678,872 B1 * 3/2014 Valencia ..... A63H 33/00 446/5
8,702,104 B2 * 4/2014 Legary ..... F41J 5/056 273/371
8,721,382 B2 * 5/2014 Maidana Otero ..... A63H 37/00 446/5
8,733,334 B2 * 5/2014 Mroczka ..... F41B 7/00 124/1
8,951,094 B2 * 2/2015 Ropelewski ..... A63H 37/00 446/475
2003/0143922 A1 * 7/2003 Du ..... A63H 37/00 446/475
2007/0119440 A1 * 5/2007 Andersen ..... A63F 7/2472 124/79
2007/0298647 A1 * 12/2007 Lee ..... A63F 9/0204 439/354
2010/0180877 A1 * 7/2010 Fielding, Jr. ..... F41B 7/08 124/16
2015/0034062 A1 * 2/2015 Willett ..... F41B 11/71 124/77
2015/0111464 A1 * 4/2015 Willett ..... A63H 37/00 446/475

* cited by examiner

PARTY CANNON

This application is a Continuation-In-Part (CIP) of co-pending patent application Ser. No. 13/654,067 filed on Oct. 17, 2012, which is based on provisional patent application Ser. No. 61/548,017 filed on Oct. 17, 2011.

BACKGROUND OF THE INVENTION

1. Field of the Invention

The present invention relates to children's party games and, more particularly, to an apparatus that launches items, including candy and small toys, out of a main container when triggered.

2. Discussion of the Related Art

It is common to have a variety of activities at children's parties to provide entertainment and fun. One of the most popular activities for children at parties, particularly birthday parties, involves the well known piñata.

A typical piñata includes a decorative body, generally made out of papier-mâché, filled with candy and toys that may be suspended from the ceiling and alternately struck by children with a stick until the body is broken and the candy and toys fall to the floor for children to collect. While piñata games of this nature have been a longstanding tradition in many cultures, there are drawbacks associated with typical piñatas. The manner in which the candy and toys fall to the floor produces a single pile of items for children to collect, which may result in only the more aggressive participants collecting all of the items, thereby leaving some children without any candy or toys. Furthermore, this disorganized approach can cause injury to children as they are forced to aggressively rush towards the pile and collide with other children in their desperate effort to collect as much candy and toys as possible, before they are quickly scooped up by other kids. Moreover, because piñatas are generally made out of papier-mâché, they are only suitable for one-time use.

In view of the shortcomings associated with traditional piñatas, there remains a need for a candy and/or toy releasing device that is fun and safe for children, and which can be reused on multiple occasions.

OBJECTS AND ADVANTAGES OF THE INVENTION

Considering the foregoing, it is a primary object of the present invention to provide an apparatus that launches items such as candy and/or small toys outwards of a main body, in a scattered fashion, thereby allowing all participants to collect some of the launched items as the items land throughout an area of a room or yard.

It is a further object of the present invention to provide a reusable apparatus for parties that launches items such as candy and small toys.

It is yet a further object of the present invention to provide an apparatus for launching candy, small toys and other items in an upward direction to create a bigger radius of distribution for children of all ages to collect the candy, small toys and/or other items.

It is still a further object of the present invention to provide an apparatus for launching candy, toys and other items at parties, and wherein the apparatus is instantly reusable.

It is a further object of the present invention to provide an apparatus for launching items such as candy and small toys, and wherein the apparatus is easy to use and minimizes the chance of injury by scattering the launched items throughout an area of a room or yard and thereby avoiding a converging rush of participants into one area.

It is still a further object of the present invention to provide an apparatus for launching candy, toys and other items, and wherein the apparatus can be personalized for a particular person to celebrate an occasion, such as a birthday.

It is yet a further object of the present invention to provide an apparatus for launching candy, toys and other items at a party, and wherein the apparatus allows for a game of skill and challenge (i.e., requiring participants to hit a target with a ball or other object).

It is still a further object of the present invention to provide an apparatus for launching candy, toys and other items, and wherein the apparatus is constructed as a stand-alone unit that can be easily transported and set up at any desired location.

These and other objects and advantages of the present invention are more readily apparent with reference to the detailed description and accompanying drawings.

SUMMARY OF THE INVENTION

The present invention is directed to an apparatus for parties, and more particularly, to a party cannon that includes a cannon body and an open-top container movably retained within the cannon body by interconnecting biasing elements. The open-top container is structured and disposed for holding candy, toys, or other items that are loosely filled therein. The open-top container, generally in the form of a bucket, is held in a loaded position against the force of the one or more biasing elements (e.g., springs, elastic bands, etc.) by a trigger and locking mechanism which, when triggered, releases the open-top container in a rapid forward movement, causing the container to immediately accelerate towards an open muzzle end of the cannon body and then quickly decelerate and stop as the biasing elements reach their stretching limit, thereby launching the items within the container outwards from the open muzzle end of the cannon body and up through the air so that the items land scattered throughout an area of a room or outdoor ground surface. In a preferred embodiment, the trigger and locking mechanism is actuated (i.e., triggered) and momentarily released by hitting a target with an object, such as a ball or bean bag. After use, the container can be re-filled with more items and then pulled back into a loaded position for another launch, thereby allowing for ongoing reuse of the party cannon at the same party and at future events.

BRIEF DESCRIPTION OF THE DRAWINGS

For a fuller understanding of the nature of the present invention, reference should be made to the following detailed description taken in conjunction with the accompanying drawings in which.

Like reference numerals refer to like referenced parts throughout the several views of the drawings.

DETAILED DESCRIPTION OF THE PREFERRED EMBODIMENT

Referring to the several views of the drawings, and initially FIGS. 1-4, the party cannon apparatus of the present invention is shown in accordance with a first embodiment and is generally indicated as 10.

Figure 1:
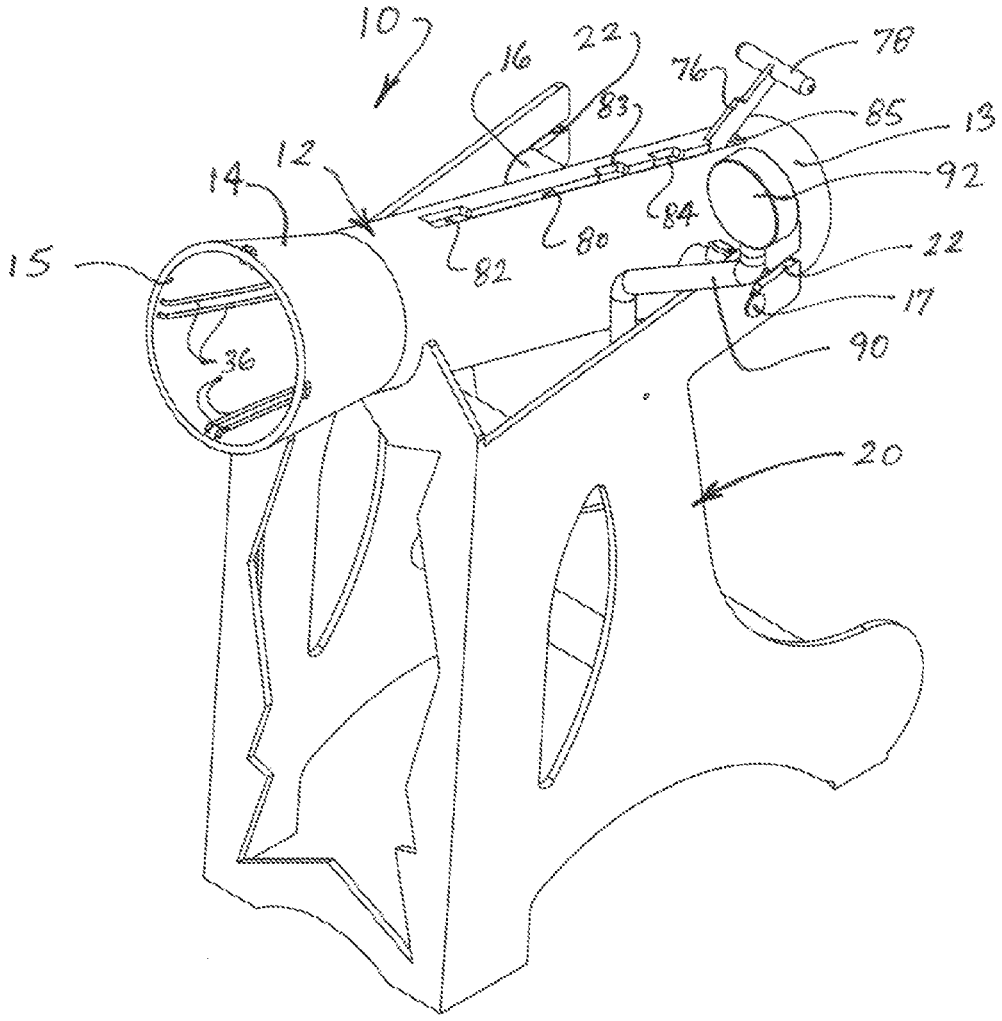
FIG. 1 is a front perspective view of the party cannon of the present invention, in accordance with a preferred embodiment thereof.
Figure 2:
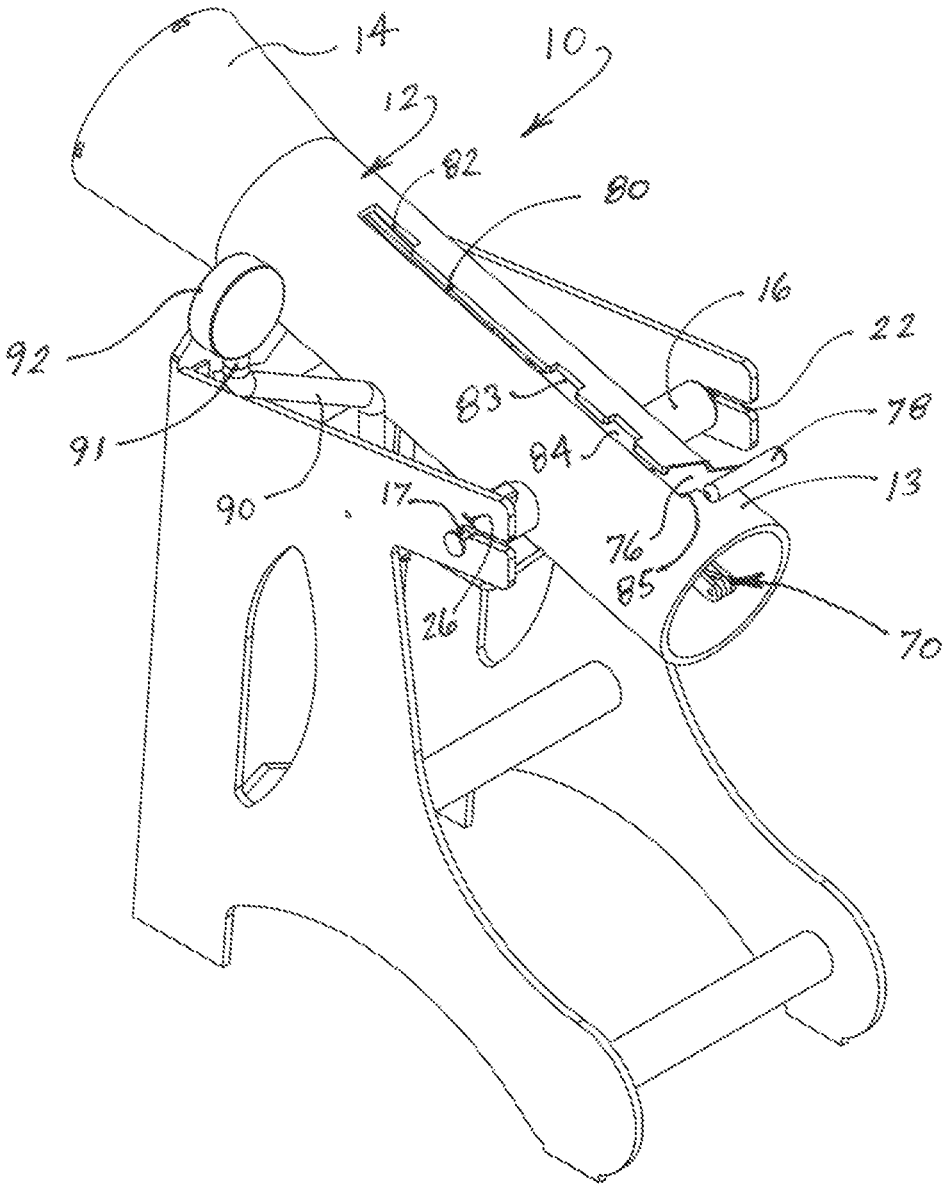
FIG. 2 is a rear perspective view of the party cannon of FIG. 1.
Figure 3:
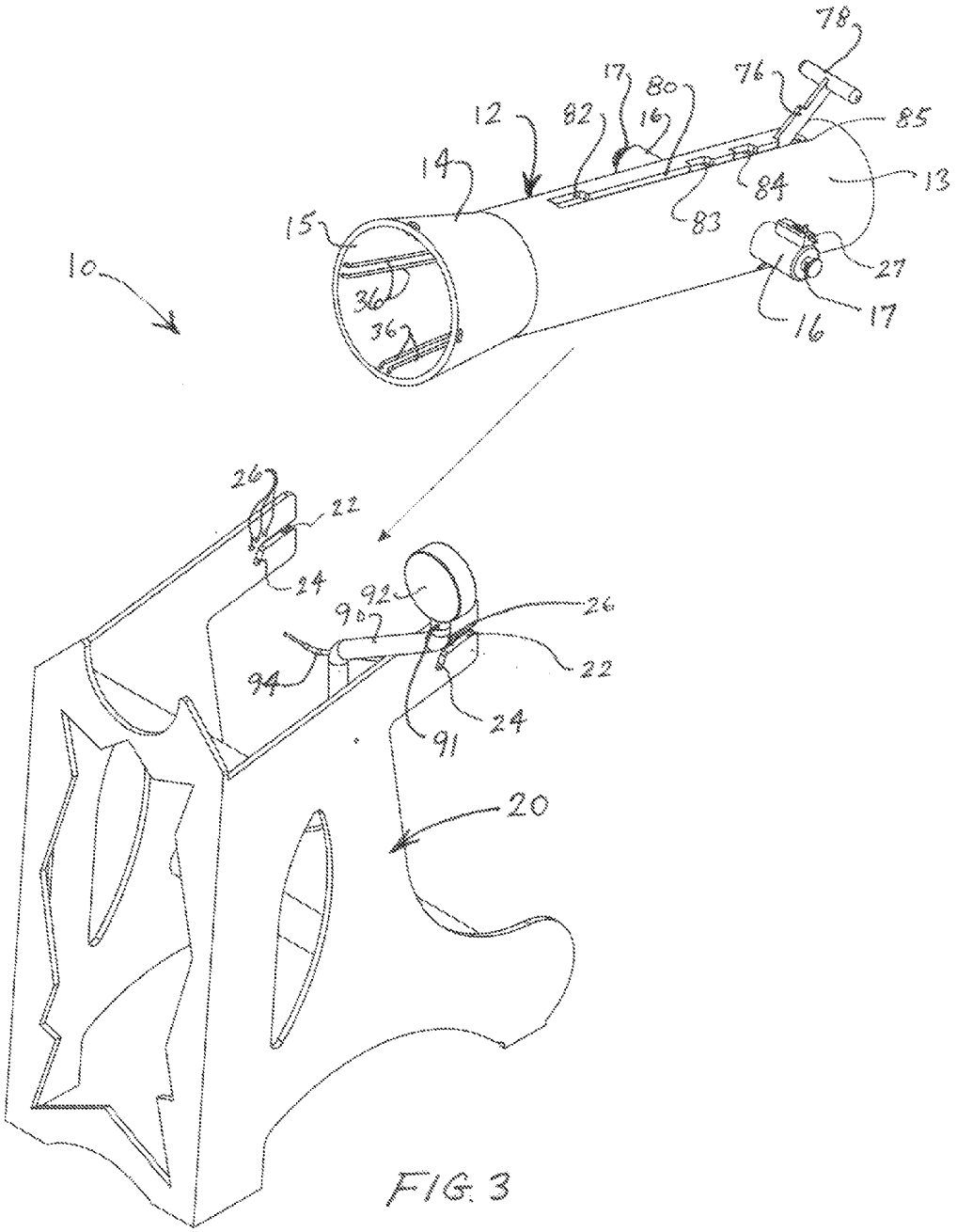
FIG. 3 is a front perspective view showing a cannon housing portion of the apparatus separated from a support base.
Figure 4:
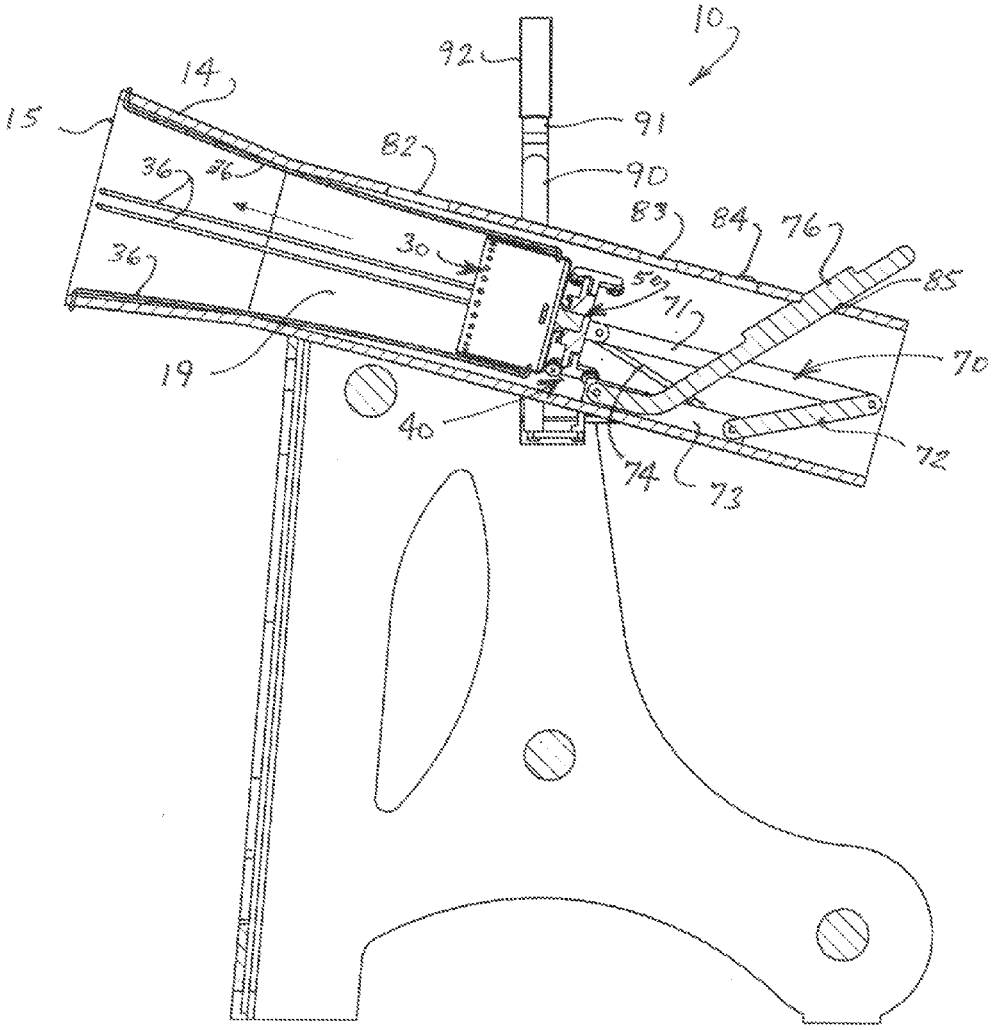
FIG. 4 is a side elevational view, in cross-section, showing the candy holding container held back by the trigger mechanism in a fully loaded position against tension.
Figure 5:
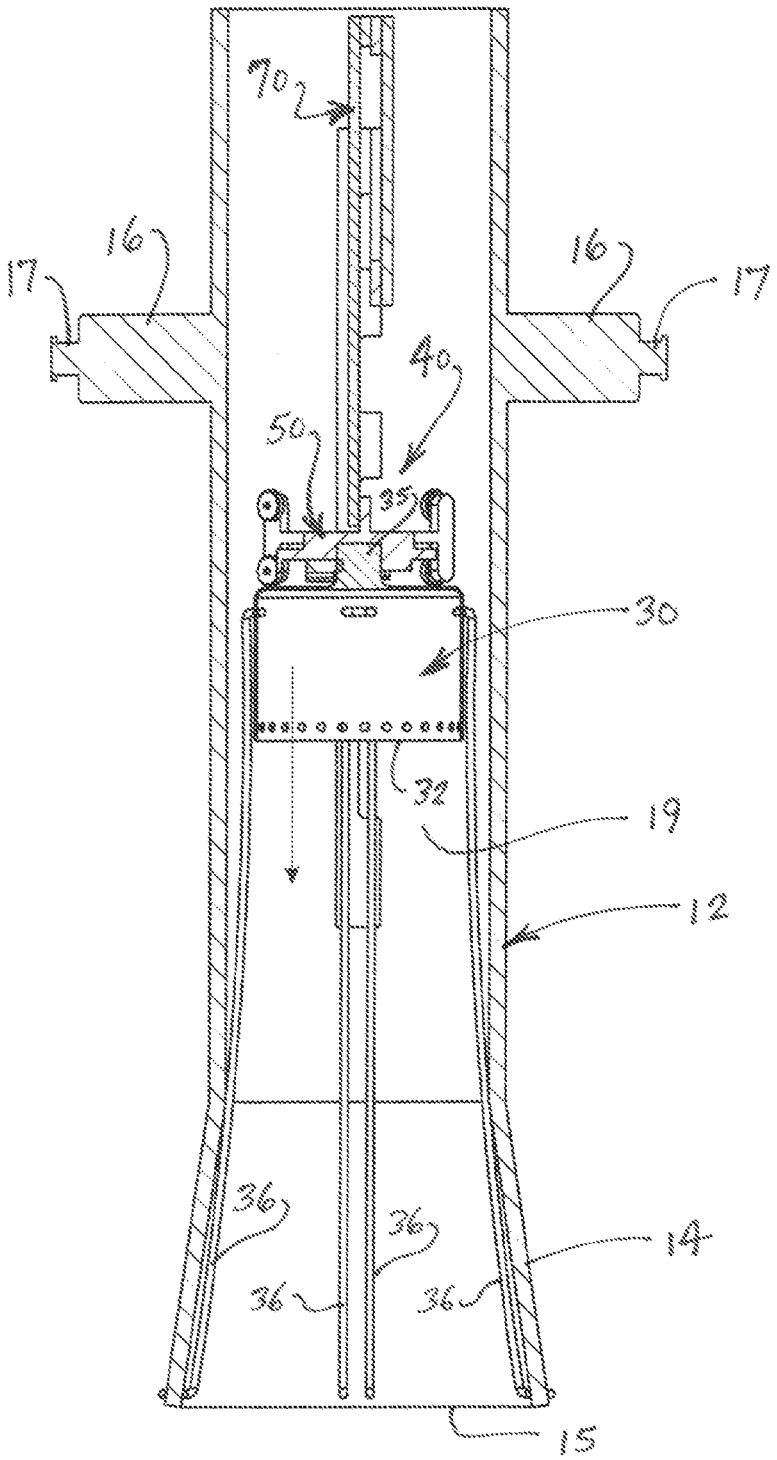
FIG. 5 is an isolated top plan view, in partial cross-section, showing the candy holding container held by the trigger mechanism in a locked (i.e., loaded) position within the cannon housing.
Figure 6:
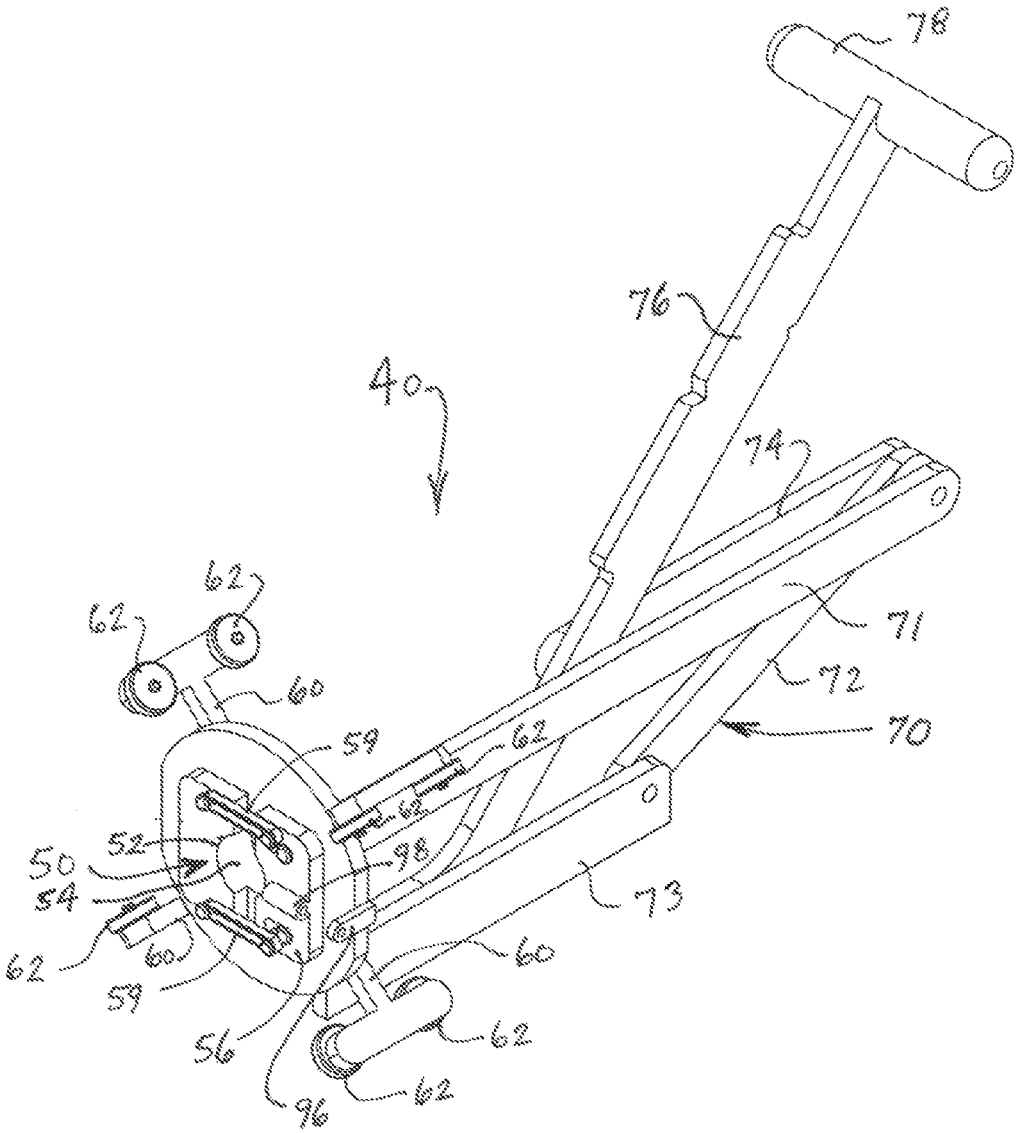
FIG. 6 is an isolated perspective view of the trigger mechanism and inter-linking loading arm.
Figure 7:
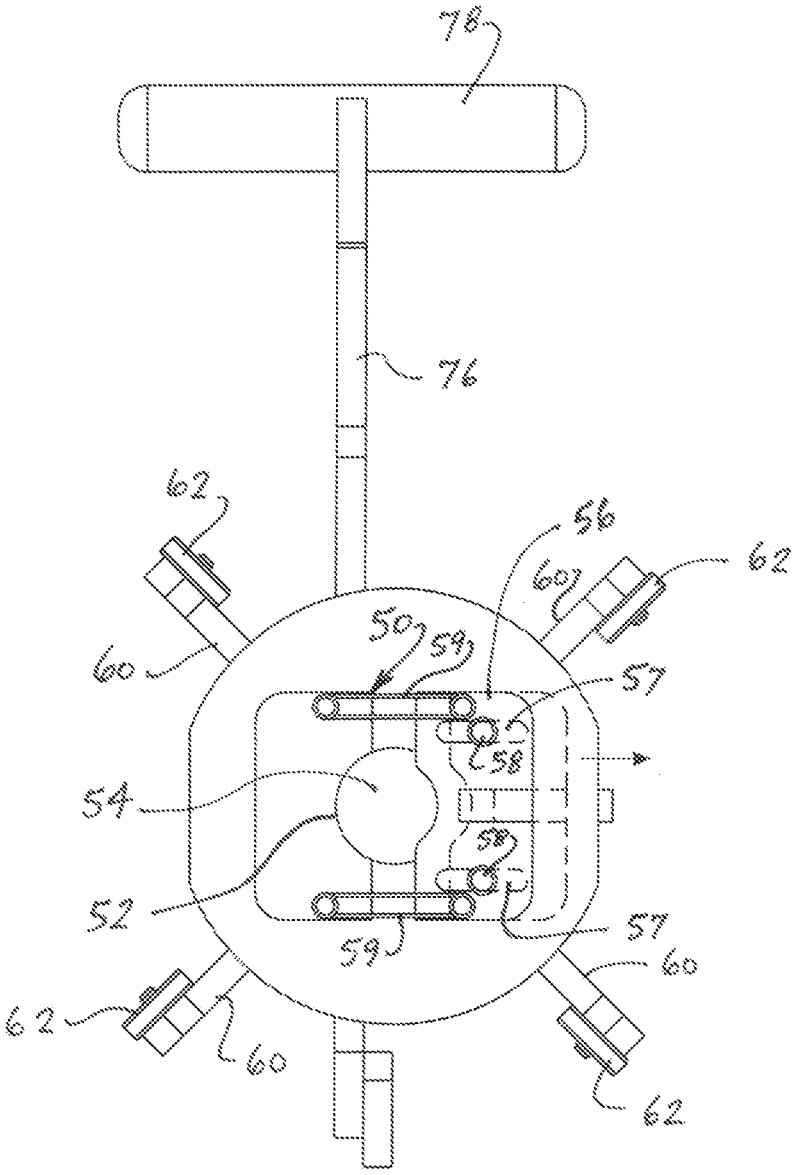
FIG. 7 is a front elevational view of the trigger mechanism and inter-linking loading arm.
Figure 8:
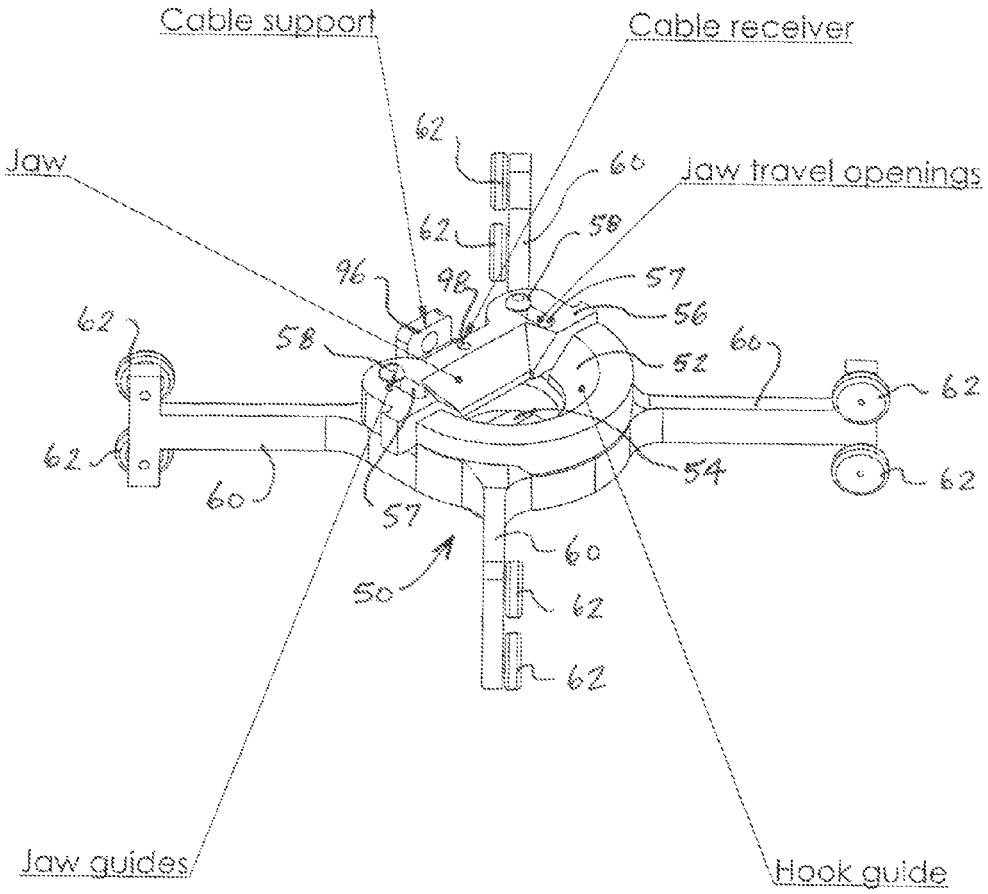
FIG. 8 is an isolated perspective view of the trigger mechanism.
Figure 9:
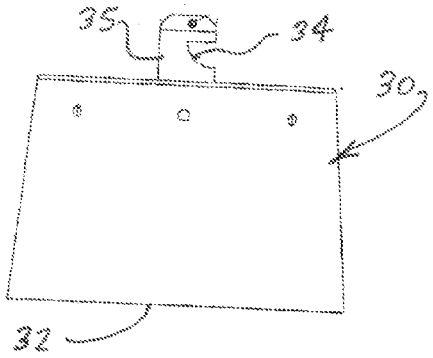
FIG. 9 is a side elevational view of the candy holding container.

As seen in FIGS. 1 and 2, the party cannon apparatus 10 includes a main cannon body 12 that has a proximal end portion 13 and a distal end portion 14 defining a muzzle, an open end 15 at the distal face of the muzzle 14, and an interior chamber 19 communicating with the open end 15. The main cannon body 12 is preferably cylindrical and, in accordance with the preferred embodiment, is in the form of a cannon barrel. The cylindrical cannon body 12 is pivotally supported at opposite sides to a support base 20. In particular, axles (i.e., trunnions) 17 extend from cannon mounts 16 on opposite sides of the cannon body 12. The axles 17 are adapted to be received within cannon mount slots 22 and down into notches 24 on opposite sides of the base 20. Adjustment holes 26 on the pivot cannon support portion of the base 20 are adapted for selecting receipt of a spring loaded locking pin 27 on the cannon mounts 16 to hold the cannon body at a desired adjusted angle. This allows for adjusted fixed positioning of the main cannon body 12 at adjusted angular positions relative to the base 20 according to the desired distance of coverage of the launched items. Once moved to the desired position, the locking pins 27 are inserted (i.e., released) into the aligned one of the adjustment holes 26 in order to fix the main cannon body 12 in the desired adjusted position, relative to the base 20, so that the open end 15 of the main cannon body is directed at the desired angle for launching candy and/or toys or other objects, as described hereinafter. The base 20 may include a removable display panel or dry erase board that allows for placement of customized messages for a party; for example, "Happy Birthday Mary."

The candy, small toys and/or other items to be launched from the party cannon apparatus 10 are initially placed within a container or basket 30 having an open top 32 and a hook mechanism 34 on a bottom. In a preferred embodiment, the hook mechanism is provided on a short stub or post 35 extending from the bottom of the basket. The basket 30 is secured to the main cannon body 12, within the interior chamber 19. Specifically, the basket is attached to the cannon body 12 with the use of a plurality of elastic bands or cords 36. In a preferred embodiment, the elastic cords 36 attach to the sides of the basket and also to the main cannon body 12, within the interior chamber 19, close to the open end 15 of the muzzle 14. The basket 30 is movable within the firing chamber of the main cannon body 12 against the biasing force of the elastic cords 36.

Referring to FIGS. 4-7, a trigger and locking assembly 40 is supported within the rear portion of the interior chamber 19 of the main cannon body 12. The trigger and locking assembly 40 is specifically structured for holding the basket 30 in a loaded position for launching, against the biasing force of the elastic bands or cords 36, and for subsequently releasing the basket so that the biasing force of the elastic cords 36 moves the basket 30 in a rapid forward movement to the open end 15 of the main cannon body 12. In one embodiment, the basket 30 exits the open end 15 of the cannon body, when released by the trigger and locking assembly, and quickly decelerates to a stopping point as the elastic cords 36 reach their stretching limit, whereby the candy, toys and/or other items are released from the open top 32 of the basket 30 and are launched through the air and scattered throughout an area of a room or outdoor ground surface.

The trigger and locking assembly 40 includes a retainer mechanism 50 that is specifically structured and disposed for releasably grasping the hook mechanism 34 on the bottom of the basket 30. The retainer mechanism 50 includes a hook guide 52 that surrounds an opening 54 for receipt of the post 35 on the bottom of the basket 30. A movable jaw 56 opposes the hook guide 52 and includes travel slots 57 that receive corresponding jaw guides 58 therein for guiding movement of the jaw 56 in relation to the hook guide 52 and opening 54. The jaw 56 is normally urged to a closed position, towards the hook guide 52, by springs, elastic bands or other biasing members 59. When urged to the normally closed position, the jaw 56 engages the hook mechanism 34 on the basket 30 to hold the hook mechanism and basket within the grasp of the retainer mechanism 50. Movement of the jaw 56 away from the hook guide 52 to a release position allows for removal of the post 35 and hook mechanism 34 of the basket from within the grasp of the retainer mechanism.

The retainer mechanism 50 further includes radiating arm members 60 with wheels 62 on the distal ends of the arm members 60 for rolling engagement with an inner wall surface 64 of the cannon body interior chamber 19. The radiating arm members 60 and wheels 62 help guide linear travel of the trigger and locking assembly 40 within the interior chamber 19, while discouraging jamming of the trigger and locking assembly 40 as it travels through the interior chamber 19.

The trigger and locking assembly 40 further includes a lever mechanism 70 that includes an arrangement of interlinking lever segments 71, 72, 73, 74 and a lever arm 76 with a handle 78 on the end of the lever arm 76. As seen in FIGS. 1-4, the lever arm 76 and interlinking lever segments 71-74 are pivotally attached and linked to the retainer mechanism 50. The lever arm 76 extends from the retainer mechanism 50 and out through an open slot 80 on the top of the cannon body 12 so that the handle 78 on the end of the lever arm 76 is maintained on the exterior of the cannon body 12. The lever arm 76 is movable between a loading position 82, at a first end of the longitudinal slot 80 and a plurality of firing positions 83, 84, 85. The loading position 82 and plurality of firing positions 83-85 are defined by notches along the longitudinal slot 80 for releasably holding the lever arm 76. Movement of the lever arm 76 along the longitudinal slot 80 between the loading position 82 and the plurality of firing positions 83-85, by grasping the handle 78, serves to move the retainer mechanism 50 longitudinally along the interior chamber of the cannon body. Use of the interlinking lever segments 71-74 provides mechanical leverage to make it easier for the user to move the lever arm 76 and retainer mechanism 50. By moving the lever arm 76 to the loading position 82, the retainer mechanism 50 is moved closer to the open end 15 of the muzzle 14. This allows the post 35 and hook mechanism 34 to be pushed into the opening 54 surrounded by the hook guide 52 on the retainer mechanism 50, as the jaw 56 is urged outwardly against the force of the biasing members 36 until the hook mechanism 34 is received within the opening 54, whereupon the jaw 56 is urged to the closed position to engage the hook mechanism 34, thereby attaching the basket 30 to the retainer mechanism 50. The basket 30 can then be pulled back through the interior chamber 19 of the cannon body 12, using the handle 78 and lever arm 76. Pulling the basket 30 back towards a rear portion of the interior chamber 19 serves to place tension on the elastic cords 36 connecting the basket 30 to the cannon body 12, as the cords 36 are stretched from a normally relaxed state. Moving the lever arm 76 to the first firing position 83 along the longitudinal slot 80 places sufficient tension on the elastic cords 36 to propel the basket 30 forward, upon release, to launch items within the basket 30 throughout a short distance. Movement of the lever arm 76 to the second firing position 84 places even greater tension on the elastic cords to increase the launch distance. Finally, moving the lever arm to the third firing position 85 along the longitudinal slot 80 places maximum tension on the elastic cords 36 to achieve the greatest distance of launch of the items contained within the basket 30 upon triggering the trigger and locking assembly 40.

A trigger arm 90 is movably supported on the base 20 and is movable between a cocked position and a firing position. A distal end 91 of the trigger arm, spaced away from the cannon body 12, has a target 92 attached thereto. Application of a force to the target 92, by hitting the target 92 with a ball, beanbag or other object, or simply pushing the target 92 with one's hand, serves to move the trigger arm 90 from the cocked position to the firing position. A Bowden cable 94, of the type commonly used for break cables on a bicycle, connects between the trigger arm 90 and the jaw 56 on the retainer mechanism 50. The sleeve of the Bowden cable 94 is held by a cable support 96 on the retainer mechanism 50 and the inner cable of the Bowden cable is attached to a cable receiver 98 on the jaw 56. When the trigger arm 90 is in the cocked position, minimal tension is placed on the Bowden cable 94 so that the jaw 56 is maintained in the closed, locked position. Upon movement of the trigger arm 90 to the firing position, increased tension is placed on the inner cable of the Bowden cable, causing the inner cable to pull the jaw 56 open, away from the hook guide 52, and against the force of the springs or other biasing members 59, thereby allowing release of the basket 30 from within the grasp of the retainer mechanism 50.

Figure 10:
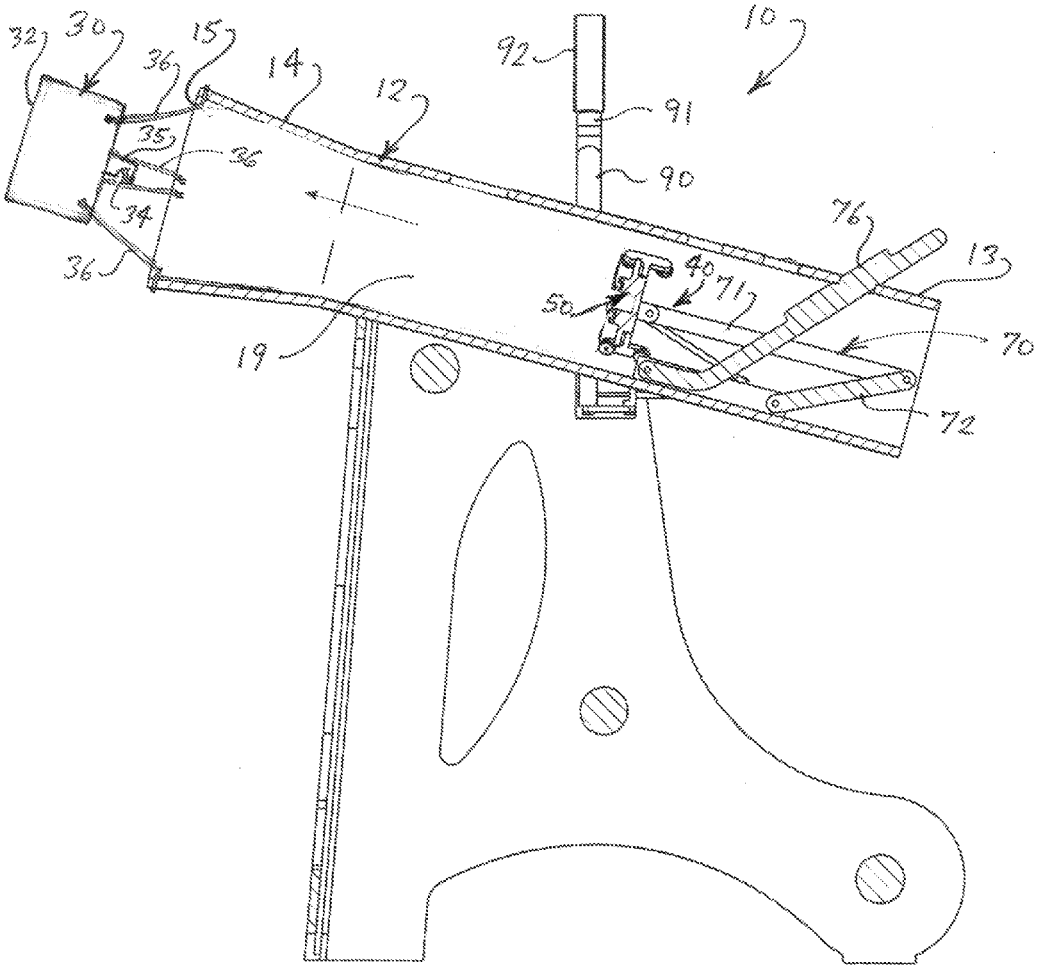
FIG. 10 is a side elevational view shown in partial cross-section, illustrating movement of the candy holding container rapidly in an outward direction toward an open top of the main cannon body of the party cannon apparatus in response to actuation of the trigger mechanism and release of the candy holding container from the loaded position.

In use, the user first must decide how far they want to launch the candy and/or other items that are discharged from the party cannon upon triggering the trigger and locking assembly 40. The user then can adjust the angle of the cannon body 12 to any one of a plurality of adjusted positions by removing the pins 27 received through the cannon support portion of the base 20 and pivoting the cannon body 12 on the axles 17 that rest within the notches of the cannon mount slot 22. When at the desired position, the pins 27 are replaced by inserting the pins 27 through the aligned holes on the base. The basket 30 can then be loaded with candy and/or other items by moving the basket forward within the interior chamber 19 towards the open muzzle end 15. This is done by moving the lever arm 76 along the longitudinal slot 80 to the loading position 82. The basket 30 can then be engaged within the grasp of the retainer mechanism 50 and loaded with candy and/or other items. The lever arm 76 is then pulled back along the longitudinal slot 80 on the top of the cannon body 12 until it reaches the several firing positions 83-85. Depending on the distance of the desired launch of the candy and other items, the user then secures the lever arm in any one of the three adjusted firing positions 83, 84 or 85, with the first firing position 83 achieving the shortest launch distance and the third firing position 85 achieving the furthest launch distance. The cannon 10 is then activated by hitting the target 92 with a ball, beanbag or similar object. Alternatively, the target 92 can be moved to the firing position with the use of one's hand. As the target 92 moves to the firing position, the inner cable of the Bowden cable 94 pulls the jaw 56 open to release the basket 30 from the grasp of the retainer mechanism 50. The basket 30 is then propelled forward, in a rapid motion through the interior chamber 19 of the cannon body 12 and out through the open muzzle mouth 15 of the cannon by the force of the elastic cords 36, as illustrated in FIG. 10. As the elastic cords 36 reach their stretching limit, the basket 30 quickly decelerates and comes to a stop as the candy and/or other items are thrown from the basket and launched in a scattered array through the air and onto the ground surface. The party cannon 10 can then be used for a subsequent launch by simply moving the lever arm 76 back to the loading position 82, setting the hook mechanism 34 and post 35 within the grasp of the retainer mechanism 50 and then repeating the steps as set forth above.

While the present invention has been shown and described in accordance with a preferred and practical embodiment, it is recognized that departures from the instant disclosure are fully contemplated within the spirit and scope of the present invention which is not to be limited, except as defined in the following claims as interpreted under the Doctrine of Equivalents.

What is claimed is:

1. An apparatus for launching items to recipients, said apparatus comprising:

a support base;

a cannon body on said support base, and said cannon body having a proximal end portion, a distal end portion defining a muzzle, and an interior chamber communicating with a discharge opening at a distal face of the muzzle;

a container for holding the items and including an open top, and said container being movable within the interior chamber of the cannon body towards and away from the discharge opening of the muzzle;

at least one biasing member securing the container to the cannon body, and the at least one biasing member being structured and disposed for urging the container towards the discharge opening of the muzzle when the at least one biasing member is tensioned by moving the container from a normally relaxed position and away from the discharge opening and towards a rear portion of the interior chamber to a loaded position;

a trigger and locking assembly comprising:

a trigger arm having a first end and an opposite second end that is exterior of the cannon body, and the trigger arm being movable relative to the cannon body between a cocked position and a firing position;

a target on the second end of the trigger arm;

a retainer mechanism structured and disposed for releasably holding the container in the loaded position;

a lever mechanism for moving the container from a first position to at least one loaded position, and the lever mechanism being connected to the retainer mechanism and including a lever arm extending out from the interior chamber of the cannon body to an exterior of the cannon body, and the lever arm including a handle on a distal end thereof, and the lever arm being structured and disposed for releasably locking the at least one loaded position;

a plurality of wheels for engaging an inner surface of the cannon body within the interior chamber to guide movement of the trigger and locking assembly within the interior chamber;

the trigger arm being operatively linked to the retainer mechanism for actuating the retainer mechanism to release the container therefrom upon movement of the trigger arm from the cocked position to the firing position; and whereby impacting the target with an external force moves the trigger arm from the cocked position to the firing position to actuate the retainer mechanism and thereby release the container from the loaded position, such that tension of the at least one biasing member causes immediate acceleration of the container through the interior chamber of the cannon body and towards the discharge opening, whereupon deceleration and stopping of forward movement of the container results in the items being launched out from the open top of the container and in a scattered array through the surrounding atmosphere.

2. The apparatus as recited in claim 1 wherein the cannon body is pivotally supported on the support base and adjustably positionable at a plurality of angled positions relative to the base.

3. The apparatus as recited in claim 2 wherein the container includes a hook mechanism for releasable engagement with the retainer mechanism.

4. The apparatus as recited in claim 3 wherein the retainer mechanism includes a spring biased jaw for releasably engaging the hook mechanism on the container.

5. The apparatus as recited in claim 4 wherein the trigger arm is operatively linked to the jaw for moving the jaw to release engagement from the hook mechanism on the container upon movement of the trigger arm from the cocked position to the firing position.

6. The apparatus as recited in claim 1 wherein the at least one biasing member is at least one elastomeric cord.

* * * * *